United States Patent [19]

Hook

[11] 4,142,748

[45] Mar. 6, 1979

[54] DOOR FURNITURE

[75] Inventor: John L. Hook, Doncaster, Australia

[73] Assignee: Gainsborough Hardware Industries Pty. Limited, Canterbury, Australia

[21] Appl. No.: 830,077

[22] Filed: Sep. 2, 1977

[30] Foreign Application Priority Data

May 5, 1977 [AU] Australia ..... PC9995

[51] Int. Cl.[2] ..... E05B 55/04; E05C 1/12; E05C 1/16

[52] U.S. Cl. ..... 292/169.15; 70/468

[58] Field of Search ..... 292/169.14, 169.16, 292/169.17, 169.15; 70/468, 470, 473

[56] References Cited

U.S. PATENT DOCUMENTS

| | | | |
|---|---|---|---|
| 2,164,290 | 6/1939 | Hurd | 292/169.15 X |
| 2,385,173 | 9/1945 | Voight | 292/169.15 |
| 2,801,536 | 8/1957 | Best | 70/468 |
| 2,998,273 | 8/1961 | Unetic | 292/169.15 |
| 3,390,910 | 7/1968 | Kuchler | 292/169.15 |
| 3,819,214 | 6/1974 | Hart et al. | 292/169.14 X |
| 3,823,585 | 7/1974 | Spon | 292/169.14 X |
| 3,858,918 | 1/1975 | McBurnie | 292/169.15 |

*Primary Examiner*—J. Franklin Foss

[57] ABSTRACT

Door lock apparatus in which a door latch mechanism is operated by inner and outer door handles coupled to a latch shaft extending through the latch mechanism. Handles are coupled to ends of latch shaft by coupling devices enabling door to be locked from the inside to prevent entry from the outside but can still be opened from the inside by normal operation of outside handle. Inside coupling device has limited lost-motion which is used to operate cam device to unlock the door on actuation of inner handles.

13 Claims, 6 Drawing Figures

DOOR FURNITURE

BACKGROUND OF THE INVENTION

This invention is concerned with the installation of door furniture particularly door handle and latch assemblies.

A door handle assembly generally comprises a pair of handles disposed one to each side of the door and coupled to a latch shaft to operate a latch which is installed in the door so that its bolt can be extended from the outer edge of the door but can be retracted by rotation of the shaft. Usually a pair of escutcheon plates are mounted against the side faces of the door to cover the hole for the latch shaft. In some cases the escutcheon plates are simply attached to the door by means of screws which remain visible but in other constructions a concealed mounting is achieved. Assemblies incorporating concealed mountings are disclosed in Australian Pat. No. 409,156 and also in our copending Australian patent application No. 16814/76 and corresponding U.S. Pat. No. 4,037,865 and Canadian application No. 258,705. In each of these cases the escutcheon plates are screw-fitted to mounting plates which are fixed to the door to carry the handles and handle shafts.

The present invention has arisen because of a demand for privacy lock sets which can be locked from one side of the door to prevent entry from the other side but can still be opened from the first side by normal operation of the handle at that side and which have much the same appearance as conventional lock sets which do not have the privacy locking function. Specifically the invention has arisen from a project to design a privacy lock set having much the same appearance as that disclosed in the above United States patent, which incorporates concealed mountings and screw-on escutcheon plates. In order to achieve this result it was necessary that the additional components needed to provide the privacy locking functions be fitted within a very confined space between the face of the door and the escutcheon plate. The invention provides a novel type of handle to shaft coupling device which enables this result to be achieved. However, from the ensuing description it will be appreciated that the invention is not limited in application to assemblies having concealed mountings and it could be applied to locksets of other types.

SUMMARY OF THE INVENTION

According to the invention there is provided a rotary coupling device for providing a rotary coupling between a door handle and a latch shaft, said device comprising:

a body;

first and second rotary coupling members mounted on the body so as to be rotatable about a common coupling axis which coupling members interengage with one another such that they can rotate independently through a limited angle of rotation only;

a locking member mounted on the body for movement between a locking position in which to lock the first coupling member against rotation about said coupling axis and a freeing position in which said first coupling member is freed for rotation about said coupling axis; and locking member release means responsive to relative rotation of the coupling members to move the locking member from its locking position to its freeing position. In use of the device, said body is fitted to one side of a door, said second coupling member is coupled to a handle at that side of the door and said first coupling member is coupled to a latch shaft which is also coupled to a further handle at the other side of the door. The device then provides a coupling between the handle at said one side of the door and the latch shaft such that at all times the latter handle is actuatable to rotate the latch, but setting of the locking member in its locking position locks the latch shaft against rotation by actuation of the handle at the other side of the door.

The invention also extends to apparatus for coupling the ends of a door latch shaft to handles at opposite sides of a door, said apparatus comprising:

a first rotary coupling device for mounting at one side of the door and including a body, a first rotary coupling member for coupling to an end of the latch shaft and mounted on said body for rotation about a coupling axis, a second coupling member for coupling to a handle at said one side of the door and also mounted on the body for rotation about said coupling axis, said first and second coupling members interengaging one another so as to be capable of rotating about said axis independently of one another through a limited angle only, a locking member mounted on the body for movement between a locking position in which to lock the first coupling member against rotation about said coupling axis and a freeing position in which said first coupling member is freed for rotation about said coupling axis, and locking member release means responsive to relative rotation of the coupling members to move the locking member from its locking position to its freeing position and a second rotary coupling device for mounting at the other side of the door and including a body and a coupling member which is rotatable on the body and, in use of the apparatus, provides a permanent coupling between the latch shaft and a handle at said other side of the door.

The locking member release means may comprise cam surfaces on said second coupling member and the locking member which surfaces interengage on said relative rotation of the first and second coupling members.

The apparatus may further comprise emergency release means comprising a release member mounted on the first coupling device so as to be rotatable about the coupling axis of that device and interengaged with the locking member so as to be effective by rotation about the coupling axis to move the locking member from its locking position to its freeing position, a release shaft extending along the coupling axis and coupled at one end to said release member and at its other end to a release actuating member mounted on the second coupling device and actuatable to rotate the release shaft.

BRIEF DESCRIPTION OF THE DRAWINGS

In order that the invention may be more fully explained one particular embodiment will be described in detail with reference to the accompanying drawings in which.

DESCRIPTION OF PREFERRED EMBODIMENT

Figure 1:
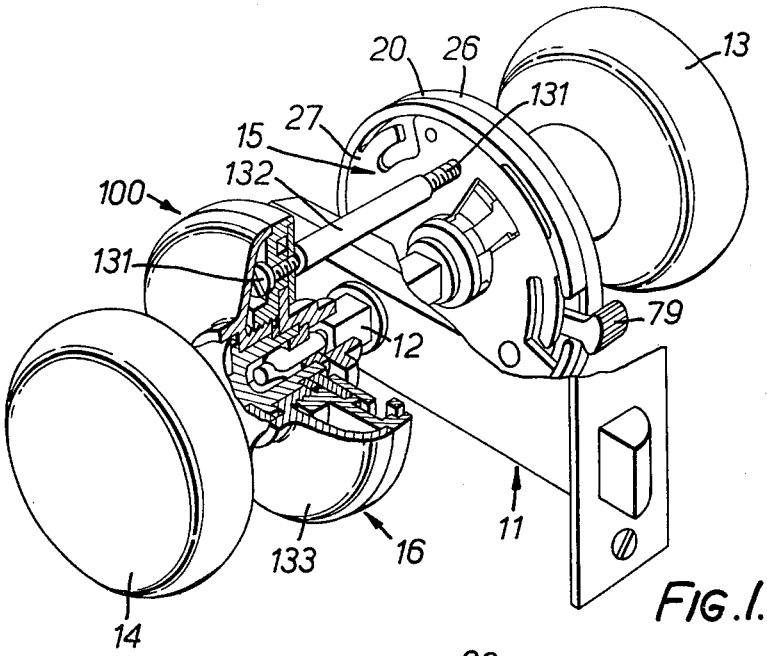
FIG. 1 is a partly broken away perpective view of a door latch and handle assembly incorporating coupling apparatus in accordance with the invention.
Figure 4:
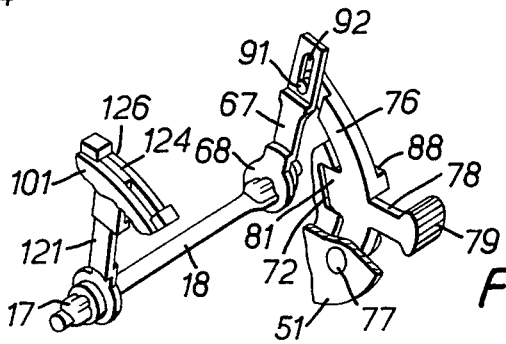
FIG. 4 is a perspective view of those components of the assembly which provide door locking and emergency release functions.
Figure 5:
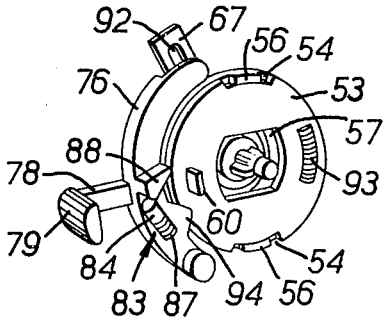
FIGS. 5 and 6 are perpective views of the components which provide the door locking and normal release functions, FIG. 5 showing these components in their door locking condition and FIG. 6 showing them in a non-locking condition.
Figure 6:
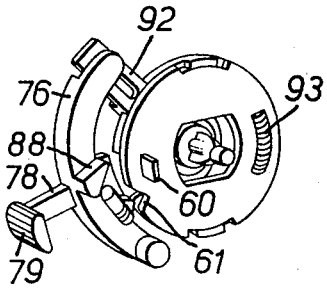
Figure 2:
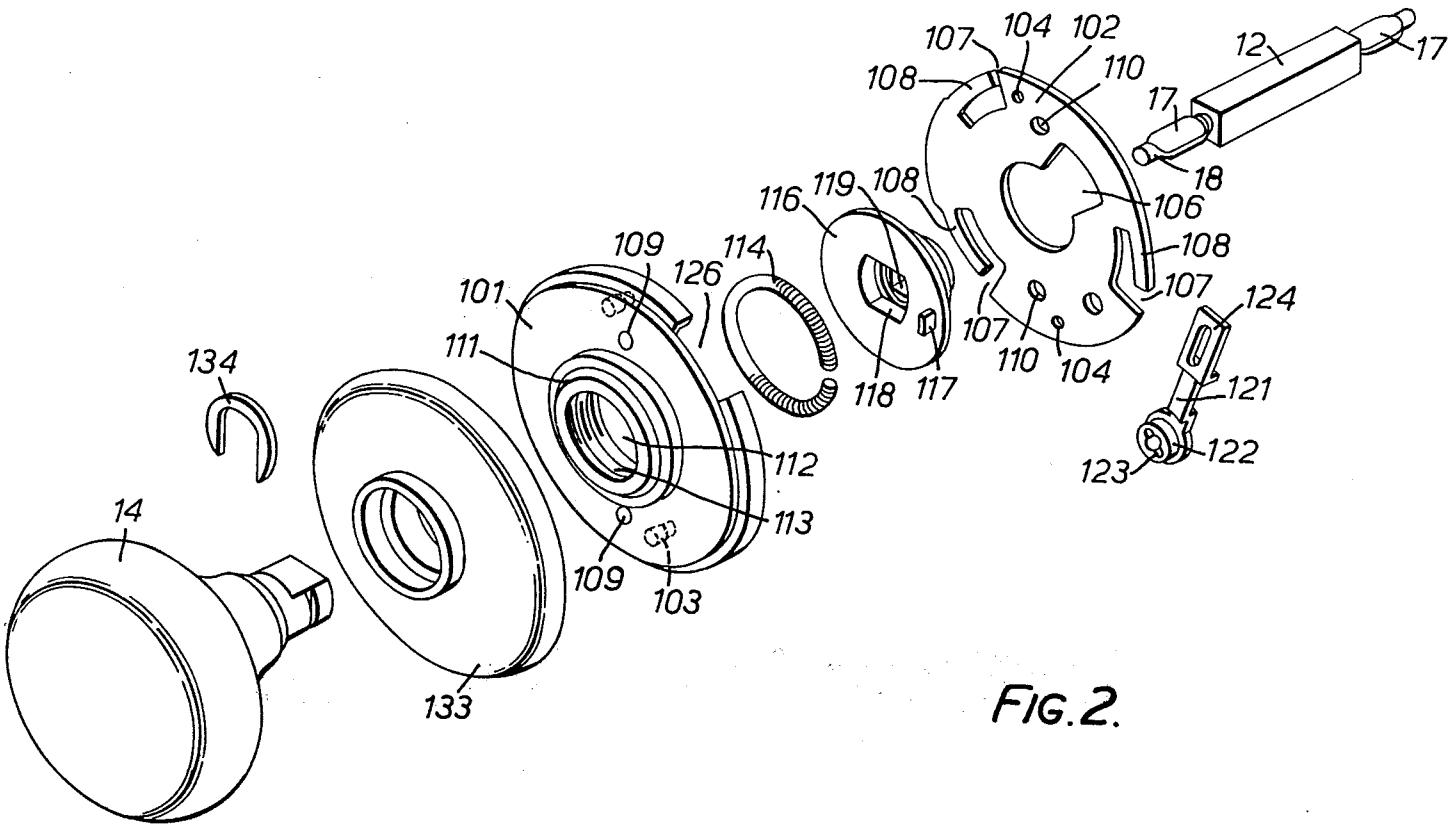
FIG. 2 is an exploded perspective view of part of the assembly and shows particularly the components of a coupling device at one side of the door.
Figure 3:
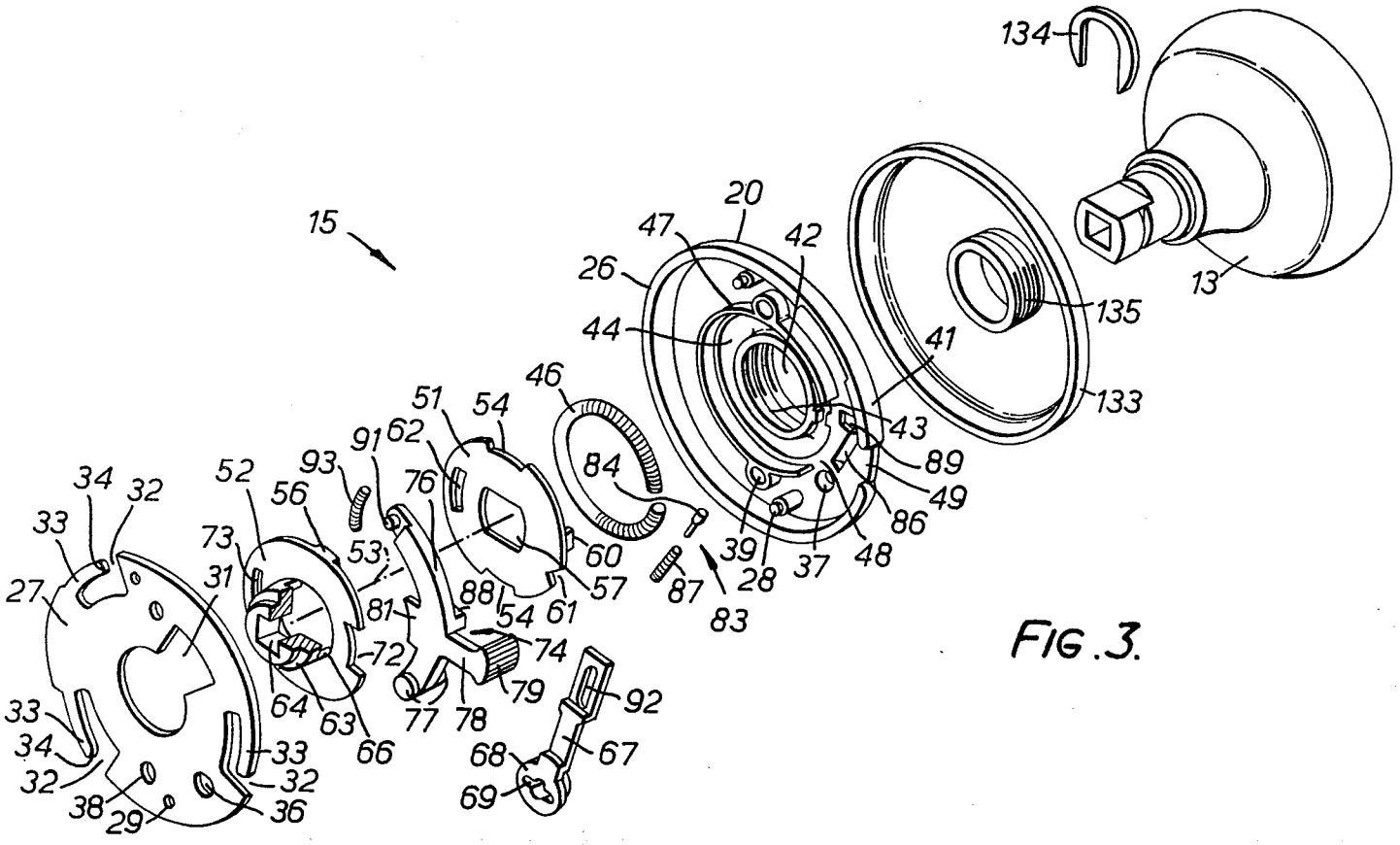
FIG. 3 is an exploded perspective view of another part of the assembly and shows particularly the components of a further coupling device at the other side of the door.

FIG. 1 illustrates a door lock apparatus in which a conventional latch mechanism 11 is operated by a latch shaft 12 rotatable by actuation of door handles 13, 14. Handle 13 is coupled to one end of the latch shaft by a coupling device denoted generally as 15 and handle 14 is coupled to the other end of the latch shaft by a coupling device denoted generally as 16. Handle 13 and coupling device 15 are installed at the privacy locking side of the door, which for convenience will be called the "inner" side and handle 14 and coupling device 16 are installed at the other or "outer" side of the door.

Coupling device 15 comprises a body 20 formed by a housing 26 and a back plate 27 which on assembly are connected together by rivet studs 28 which are formed on housing 26 to engage with holes 29 in back plate 27. Holes 29 are counter-sunk at the back face of plate 27 and after studs 28 have been inserted into these holes their ends are deformed by punching so as to be expanded and so hold the housing and back plate together.

Back plate 27 is in the form of a flat circular disc having a central key-hole opening 31 and three peripheral notches 32 which form a set of three circumferentially extending tongues 33 spaced radially inwardly from the outer periphery of the disc. The free ends 34 of tongues 33 are displaced laterally of the disc in the direction away from the housing 26.

Backing plate 27 also has a hole 36 which registers with a hole 37 in housing 26 when body 20 is assembled and two other diametrically opposed holes 38 which register with holes 39 in housing 26.

Housing 26 has a narrow peripheral flange or rim 41 and backing plate 27 fits neatly within this rim so that the assembled body 20 is in the form of a thin generally cylindrical casing. The housing also has a central circular opening 42 surrounded at the outside of the body by an annular boss to provide an extended peripheral surface for the central opening which surface is internally screw threaded at 43. The central boss also allows a deep annular groove 44 to be formed in the inner face of housing 26 immediately radially outwardly from opening 42. This groove 44 receives a helical compression spring 46 for a purpose to be described below.

An arcuate flange 47 is formed on the inner face of housing 6 concentrically with groove 44 and hole 42. It forms rather more than ¾ of a full circle but has a gap at position 48 which is generally radially aligned with a gap 49 in the rim 41 of housing 26. Flange 47 provides a journal mounting for a pair of coupling discs 51, 52. These discs are located side by side within the cylindrical space defined by flange 47 with their rims fitting snugly within the flange. They are thus mounted on the body to rotate about a central coupling axis 53.

Disc 51 has a pair of diametrically opposed peripheral notches 54 which are engaged by a pair of lugs or dogs 56 projecting laterally from disc 52 adjacent its periphery. Dogs 56 are narrower than notches 54 in the circumferential direction and the two discs can therefore rotate independently through a limited angle of about 10° determined by the engagement of dogs 56 with the ends of slots 54. If either of the discs is rotated from an initial position through more than about 5° in either direction the interengaged dogs 56 and slots 54 provide a rotary coupling whereby the other disc will be rotated with it.

Disc 51 has a central opening 57 having two flat sides 58 and this opening serves as a socket to receive the complementary shaped end of the shaft of door handle 13 whereby handle 13 is permanently coupled to disc 51. Disc 51 also has a small V-shaped peripheral notch 61 and an arcuate slot 62 for reasons to be explained below. It also has a laterally outwardly projecting lug 60 which projects into slot 44 in housing 26 between the ends of spring 46.

Disc 52 has a central hub 63 provided with a square recess 64 to receive an end of latch shaft 12 whereby to provide a permanent coupling between that disc and the latch shaft. Hub 63 also has a circumferential slot 66 which extends around approximately one-half of the circumference of the hub immediately adjacent the flat annular part of disc 52. An emergency release lever 67 extends through this slot and the inner end 68 of this lever has a slotted opening 69 to receive one of the flattened ends 17 of an emergency release shaft 18 which extends through a central bore in latch shaft 12 and is rotatable therein. Emergency release lever 67 is thus coupled to the inner end of emergency release shaft 18.

Disc 52 also has a peripheral notch 72 spaced midway between dogs 56 in the circumferential direction to one side of the disc and an arcuate slot 73 at the other side of the disc.

As thus-far described, rotary coupling device 15 comprises a body 20 formed by housing 26 and backing plate 27, and a pair of coupling discs 51, 52 mounted on the body for rotation about a coupling axis 53 and interengageable through dogs 56 and slots 54 so as to be rotatable independently of one another through a limited angle only. Disc 52 is permanently coupled to latch shaft 12 and disc 31 is permanently coupled to the inner door handle 13.

Coupling device 15 also includes a locking member 74 which is movable on the body between a position in which it locks disc 52 against rotation and a freeing position in which that disc is freed for rotation about coupling axis 53.

Locking member 74 comprises an arcuate lever arm 76 fitted at one end with bosses 77 which fit into the holes 36, 37 in backing plate 27 and housing 26 to form a pivot mounting about which lever arm 76 can pivot toward and away from disc 52. Locking member 74 also comprises an actuator arm 78 which projects outwardly through the slot 49 in housing rim 41 and has a serrated head 79 which is located immediately outside the housing. By manipulating head 79 circumferentially of housing 26 lever 74 can be swung about its pivotal mounting. The locking member also comprises a locking dog 81 to fit into the peripheral notch 72 of disc 52 when lever arm 74 is pivoted inwardly thereby to lock disc 52 against rotation.

Locking member 74 is pivotable from an inner position in which its locking dog 81 engages disc notch 72 so to lock disc 52 against rotation and an outer position in which dog 81 is disengaged from notch 72 and the disc is thereby freed to rotate. A detent means 83 is provided to produce a snap action by which the locking member snaps between these two positions and is held under spring pressure in either selected position. This detent means comprises a round-nosed detent pin 84 mounted in a slot 86 in the inner face of housing 26 and spring loaded by a detent spring 87 so as to slide on a cam surface formed on a lug 88 which projects laterally from lever arm 74 to move in a slot 89 in the wall of housing 26.

The swinging end of lever arm 74 is provided with a laterally projecting boss 91 which engages a slot 92 in the outer end of emergency release lever 67 so that pivoting movement of locking member 74 is accompanied by rotation of lever 67 about the central coupling axis 53.

As will be explained more fully below coupling device 16 provides a permanent coupling between latch shaft 12 and handle 14 at the outer side of the door. When neither of the handles is actuated discs 51, 52 of coupling device 15 are held in accurate angular alignment with respect to one another by means of a small helical compression spring 93 which is mounted in the slots 62 and 73 of the discs. The spring acts on the ends of both slots and so tends to hold the two discs in an initial angular alignment position in which dogs 56 are located centrally of disc notches 54. If either handle is actuated, however, relative rotation of the discs can occur to the small extent ($\pm 5°$) permitted by the movement of the dogs 56 of disc 52 within the peripheral notches 54 of disc 51. After this initial relative movement the dogs 56 and notches 54 provide a coupling whereby the disc which is rotated by operation of a handle then drives the other disc. Thus, when the locking member 74 is in its freeing position latch shaft 12 can be rotated by actuation of either handle but in the case when the inner door handle is actuated there will be a small angular movement of that handle and disc 51 before the latch shaft is rotated.

The rotation of disc 51 consequent to actuation of either handle causes its lug 60 to move in slot 44 to compress spring 46 and when the handle is released spring 46 returns disc 51 and the inner handle back to their initial positions. A similar spring in coupling device 16 returns the outer handle, latch shaft 12 and disc 52 to their internal positions. However, the main return springs are then relatively slack and spring 93 is able to accurately re-align the discs relative to one another.

When locking member 74 is moved to its locking position disc 52 and latch shaft 12 cannot be rotated by actuation of the outer handle. However, coupling device 15 includes a locking member release means which is responsive to relative rotation between discs 51, 52 to move locking member 74 to its freeing position if inner handle 13 is actuated. This locking release means is comprised of the circumferential V-shaped notch 61 on disc 51 and a triangular tongue 94 on the inner edge of lever arm 76. Tongue 94 engages disc notch 61 when the locking member is moved to its locking position but the relative rotation of the discs permitted by the movement of the dogs 56 within notches 54 is such that the initial rotary movement of disc 51 consequent to actuation of the inner handle causes tongue 94 to ride out of notch 61 on to the rim of disc 51 thereby to pivot the locking member outwardly to its freeing position by the time that dogs 56 engage the ends of notches 54 so that on continued movement of the handle the two discs are coupled together and disc 52 is driven to rotate latch shaft 12.

Coupling device 16 comprises a body 100 formed by a housing 101 and a backing plate 102 which are generally similar to the housing and backing plate of coupling device 15 and which fit together in similar fashion by the interengagement of rivet studs 103 on housing 101 and holes 104 in the backing plate. The backing plate has a central keyhole opening 106 and three peripheral notches 107 defining three circumferentially extending tongues 108, the tips of which are laterally displaced away from housing 101. The backing plate has two diametrically opposed holes 110 which register with holes 109 in the housing. The housing has an outwardly projecting central boss 111 and a central opening 112 which is internally screw threaded at 113.

The inner annular face of housing 101 has a deep circumferential groove which receives a compression spring 114 and an arcuate flange (not shown) projects inwardly from that face of the housing to form a recess which receives a disc 116 which is thereby mounted for rotation about the central coupling axis. Disc 116 carries a laterally projecting lug 117 which fits between the ends of compression spring 114. Disc 116 also has a central boss which has towards the outer side of the disc an opening 118 formed with two opposed flat surfaces and at the inner side of the disc a square opening 119. Opening 118 receives the inner end of the shaft of outer door handle 14 and opening 119 receives the outer end of latch shaft 12.

The central boss of disc 116 also has an arcuate circumferential slot and a lever 121 projects inwardly through this slot to a central lever hub 122 which is rotatable about the coupling axis and has a slotted opening 123 to receive the outer flattened end portion of emergency release shaft 18. Lever 121 projects radially outwardly from the central coupling axis and its outer end 124 moves in a slot 126 formed in the rim of housing 101. The outer end 124 of lever 121 is slotted only for the reason that, for production purposes, this lever is identical to the lever 67 of coupling device 15. In coupling device 16 the slot has no operative function.

The illustrated apparatus may conveniently be mounted on a door which is pre-drilled with a transverse hole having a diameter such that the laterally displaced ends of the circumferential tongues 33 and 108 of the two coupling device bodies fit snugly into the two ends of the hole to accurately locate the coupling devices so that they have a common coupling axis which is properly aligned with the line of latch shaft 12. The bodies of the two coupling devices are drawn toward one another so as to be clamped against the two faces of the door by means of screws 131 which fit through the holes 38, 39 of the coupling device 15 and 109, 110 of coupling device 16 to engage internally screw threaded spacer tubes 132 extending between the two coupling devices within the transverse hole in the door.

The bodies of the coupling devices are covered by escutcheon plates 133 held to the door handle shafts by circlips 134 and having externally screw threaded central bosses 135 which screw into the internally screw-threaded openings of the two body housings 26, 101.

In the complete lock-set assembly the door may be locked from the inside by actuation of the head 79 of locking member 74. As previously described this prevents latch shaft 12 from being rotated by actuation of the outer handle but locking member 74 is moved to is freeing position on actuation of the inner handle so that the door can be opened from the inside by normal actuation of the inner handle. When latch shaft 12 has been rotated by actuation of either handle, the outer handle, the latch shaft and disc 52 are returned to their initial positions by the operation of springs 114 on disc 116 via the lug 117 and as previously explained the inner handle of disc 51 is returned by the similar operation of spring 46. Aligning spring 93 acts initially to align the two discs so that dogs 56 are located centrally within notches 54 so that there is an initial lost motion of about 5° on actuation of the inner handle in either direction which is sufficient to cause the triangular cam 94 on locking member 74 to ride out of the V-shaped notch 61 in disc 51 so as to unlock the door.

Lever 67 of coupling device 15, shaft 18 and lever 121 of coupling device 16 constitute an emergency release means which enables the door to be unlocked from the outside in an emergency situation. The rims of the escutcheon plate 133 on the outside of the door is slotted at 136 to expose the slot 126 of housing 101 but lever 121 does not project appreciably from the slot 126 so cannot be finger actuated. However, in an emergency situation it can be moved with a suitable instrument such as a hair-pin to rotate central shaft 18 and thereby rotate the lever 67 in a coupling device 15 so as to push locking member 74 outwardly to its freeing position.

In the illustrated apparatus the privacy locking components fit with very thin housings which can be covered by escutcheon plates of conventional appearance. Moreover, the privacy locking components act on two coaxial central shafts and are operated by rotary movements. None of these components need be mounted on outer cover members of the lock set nor is it necessary to drill extra holes in the outer covers or in the door. It is therefore possible to use conventional screw-on escutcheon plates and to achieve a lock set which has the same appearance as a conventional lock set with concealed mountings. In fact the illustrated components may be sold as an adaptor set to convert an existing conventional lock set to one with privacy locking features. However, the illustrated apparatus has been advanced by way of example only and it could be modified considerably to suit lock sets of different size or appearance of having different mounting means. It is accordingly to be understood that the invention is in no way limited to the details of the illustrated apparatus and that many modifications and variations will fall within the scope of the appended claims.

I claim:

1. A rotary coupling device for providing a rotary coupling between a door handle and a latch shaft, said device comprising:

a body:

first and second rotary coupling members mounted on the body so as to be rotatable about a common coupling axis which coupling members interengage with one another such that they can rotate independently through a limited angle of rotation only;

a locking member mounted on the body for movement between a locking position in which to lock the first coupling member against rotation about said coupling axis and a freeing position in which said first coupling member is freed for rotation about said coupling axis; and locking member release means responsive to relative rotation of the coupling members to move the locking member from its locking position to its freeing position.

2. A rotary coupling device as claimed in claim 1, wherein said first rotary coupling member is provided with a socket for connection with a handle shaft and said second rotary coupling member is provided with a socket for connection with a latch shaft.

3. A rotary coupling device as claimed in claim 1, wherein the locking member release means comprises cam surfaces on said second coupling member and the locking member which surfaces interengage on said relative rotation of the first and second coupling members so as to move the locking member from its locking position to its freeing position.

4. A rotary coupling device as claimed in claim 1, wherein said coupling members are comprised of a pair of coupling discs mounted side by side on said body for rotation about said coupling axis, and there is at least one circumferential slot in one of the discs engaged by a lateral projection on the other of the discs which projection is narrower than the slot in the circumferential direction whereby the two discs can rotate independently of one another through a limited angle determined by engagement of said projection with the ends of the slot.

5. A rotary coupling device as claimed in claim 4, wherein the first coupling member has a peripheral notch and the locking member comprises a lever arm pivotally mounted on said body for pivoting movement toward and away from the periphery of the first coupling member and provided with a locking projection to engage said peripheral notch in the first coupling member when the lever arm is pivoted inwardly thereby to lock the first coupling member against rotation about said coupling axis.

6. A rotary coupling device as claimed in claim 1, wherein there is a first biasing means acting between the body and one of the coupling members tending to return that coupling member to an initial position and second biasing means acting between the first and second coupling members tending to maintain angular alignment of the coupling members relative to one another.

7. Apparatus for coupling the ends of a door latch shaft to handles at opposite sides of a door, said apparatus comprising:

a first rotary coupling device for mounting at one side of the door and including a body, a first rotary coupling member for coupling to an end of the latch shaft and mounted on said body for rotation about a coupling axis, a second coupling member for coupling to a handle at said one side of the door and also mounted on the body for rotation about said coupling axis, said first and second coupling members interengaging one another so as to be capable of rotating about said axis independently of one another through a limited angle only, a locking member mounted on the body for movement between a locking position in which to lock the first coupling member against rotation about said coupling axis and a freeing position in which said first coupling member is freed for rotation about said coupling axis, and locking member release means responsive to relative rotation of the coupling members to move the locking member from its locking position to its freeing position; and a second rotary coupling device for mounting at the other side of the door and including a body and a coupling member which is rotatable on the body and, in use of the apparatus, provides a permanent coupling between the latch shaft and a handle at said other side of the door.

8. Apparatus as claimed in claim 7, wherein the locking member release means comprises cam surfaces on said second coupling member and the locking member which surfaces interengage on said relative rotation of the first and second coupling means to move the locking member from its locking position to its freeing position.

9. Apparatus as claimed in claim 7, wherein said coupling members are comprised of a pair of coupling discs mounted side by side on the body of the first rotary coupling device for rotation about said coupling axis, and there is at least one circumferential slot in one of the discs engaged by a lateral projection on the other of the discs which projection is narrower than the slot in the circumferential direction whereby the two discs can rotate independently of one another through a limited angle determined by engagement of said projection with the ends of the slot.

10. Apparatus as claimed in claim 7, wherein the first coupling member has a peripheral notch and the locking member comprises a lever arm pivotally mounted on said body for pivoting movement toward and away from the periphery of the first coupling member and provided with a locking projection to engage said peripheral notch in the first locking member when the lever arm is pivoted inwardly to lock the first coupling member against rotation about said coupling axis.

11. Apparatus as claimed in claim 10, wherein the locking member release means comprises a peripheral notch in said second coupling member and a tooth on said lever arm which tooth engages the peripheral notch in the second coupling member when the lever arm is pivoted inwardly to its locking position but rides out of that notch on said relative rotation of the first and second coupling members to cause outward pivoting movement of said lever arm.

12. Apparatus as claimed in claim 7, wherein said second rotary coupling device includes biasing means acting between the coupling member and the body of that device so as to tend to return the coupling member of the second coupling device and, via the latch shaft, said first coupling member of the first coupling device to an initial angular position and wherein the second rotary coupling device comprises a first biasing means acting between the body of the second coupling device and said second coupling member of that device so as to tend to return said second coupling member to an initial angular position and second biasing means acting between the first and second coupling members so as to tend to maintain angular alignment of the first and second coupling members relative to one another.

13. Apparatus as claimed in claim 7, and further including emergency release means comprising a release member mounted on the first coupling device so as to be rotatable about the coupling axis of that device and interengaged with the locking member so as to be effective by rotation about the coupling axis to move the locking member from its locking position to its freeing position, a release shaft extending along the coupling axis and coupled at one end to said release member and at its other end to a release actuating member mounted on the second coupling device and actuable to rotate the release shaft.

* * * * *